US010642188B2

(12) United States Patent
Ishida

(10) Patent No.: US 10,642,188 B2
(45) Date of Patent: May 5, 2020

(54) TONER CASE AND IMAGE FORMING APPARATUS

(71) Applicant: KYOCERA Document Solutions Inc., Osaka (JP)

(72) Inventor: Hideki Ishida, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/358,284

(22) Filed: Mar. 19, 2019

(65) Prior Publication Data

US 2019/0302649 A1 Oct. 3, 2019

(30) Foreign Application Priority Data

Mar. 28, 2018 (JP) ..... 2018-062508

(51) Int. Cl.
*G03G 15/08* (2006.01)
*G03G 21/16* (2006.01)

(52) U.S. Cl.
CPC ..... *G03G 15/0875* (2013.01); *G03G 15/0886* (2013.01); *G03G 15/0891* (2013.01); *G03G 21/1647* (2013.01); *G03G 2215/0665* (2013.01); *G03G 2215/0827* (2013.01)

(58) Field of Classification Search
CPC ..... G03G 15/0875; G03G 15/0886; G03G 15/0891; G03G 21/1647; G03G 2215/0665; G03G 2215/0827
See application file for complete search history.

(56) References Cited

U.S. PATENT DOCUMENTS

| | | | | |
|---|---|---|---|---|
| 9,146,501 | B2 | 9/2015 | Kikuchi et al. | |
| 9,400,450 | B2 | 7/2016 | Kikuchi et al. | |
| 2009/0162107 | A1* | 6/2009 | Yoshikawa | G03G 15/0875 399/263 |
| 2014/0140736 | A1* | 5/2014 | Miyamoto | G03G 15/0877 399/258 |
| 2014/0219688 | A1* | 8/2014 | Murata | G03G 15/0877 399/258 |

FOREIGN PATENT DOCUMENTS

JP 2014224971 A 12/2014

* cited by examiner

*Primary Examiner* — Gregory H Curran
(74) *Attorney, Agent, or Firm* — Studebaker & Brackett PC

(57) ABSTRACT

A toner case includes a case main body, a conveying member and a transmitting member. The case main body is configured to store a toner and has a discharge port for the toner. The conveying member is configured to rotate around a rotation axis extending along a rotation axis direction and to convey the toner in the case main body to the discharge port. The transmitting member is configured to transmit rotation to the conveying member. The conveying member is movable along the rotation axis direction with respect to the transmitting member between a coupling position where the conveying member is coupled to the transmitting member and a release position where a coupling of the conveying member to the transmitting member is released.

12 Claims, 13 Drawing Sheets

TONER CASE AND IMAGE FORMING APPARATUS

INCORPORATION BY REFERENCE

This application is based on and claims the benefit of priority from Japanese patent application No. 2018-062508, filed on Mar. 28, 2018, which is incorporated by reference in its entirety.

BACKGROUND

The present disclosure relates to a toner case and an image forming apparatus including the toner case.

An image forming apparatus forming an image on a sheet by an electrophotographic way, such as a copying machine and a printer, includes a development device. Inside the development device, a developer containing a toner is stored. The development device develops an electrostatic latent image formed on an image carrier, such as a photosensitive drum, by the toner contained in the developer. By performing such development processing, an amount of the toner in the development device is decreased. Thereby, the image forming apparatus includes a toner case in which the toner is stored, and the toner is replenished from the toner case to the development device. The toner case is detachably attached to an attachment part provided in the image forming apparatus. When the toner case becomes empty, it is replaced with a new toner case filled with the toner.

For example, the toner case includes a case main body having a discharge port for the toner, a conveying member conveying the toner in the case main body to the discharge port and a transmitting member transmitting rotation to the conveying member.

SUMMARY

In accordance with an aspect of the present disclosure, a toner case includes a case main body, a conveying member and a transmitting member. The case main body is configured to store a toner and has a discharge port for the toner. The conveying member is configured to rotate around a rotation axis extending along a rotation axis direction and to convey the toner in the case main body to the discharge port. The transmitting member is configured to transmit rotation to the conveying member. The conveying member is movable along the rotation axis direction with respect to the transmitting member between a coupling position where the conveying member is coupled to the transmitting member and a release position where a coupling of the conveying member to the transmitting member is released.

In accordance with an aspect of the present disclosure, an image forming apparatus includes the toner case and an attachment part to which the toner case is detachably attached.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

A First Embodiment

Hereinafter, with reference to FIG. 1 to FIG. 6, an image forming apparatus 1 according to a first embodiment of the present disclosure will be described. Arrows Fr, Rr, L, R, U and Lo suitably marked in each figure respectively indicate a front side, a rear side, a left side, a right side, an upper side and a lower side of the image forming apparatus 1.

First, an entire structure of the image forming apparatus 1 will be described. The image forming apparatus 1 is a color printer, for example.

Figure 1:
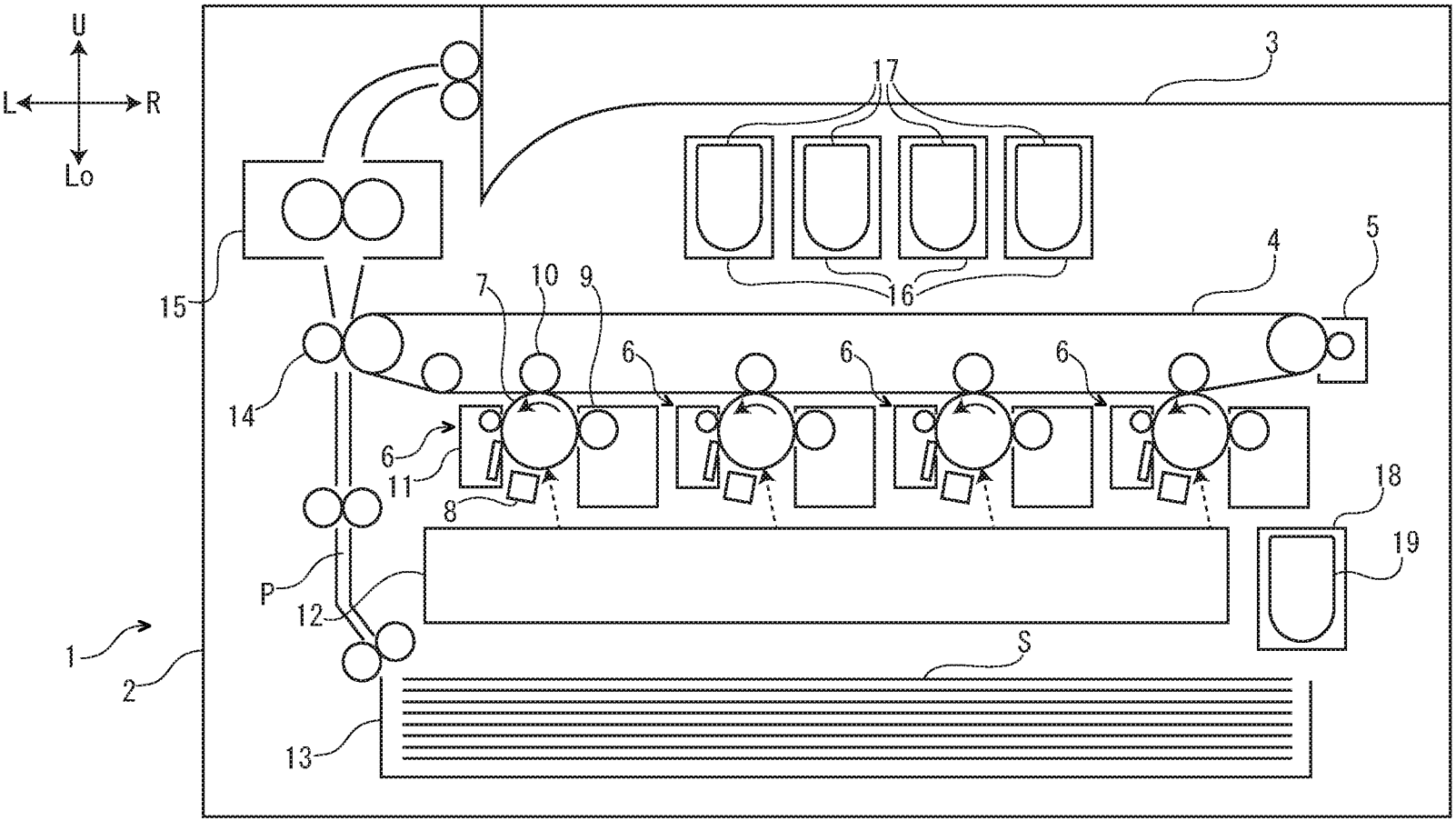
FIG. 1 is a schematic view showing an image forming apparatus according to a first embodiment of the present disclosure.

With reference to FIG. 1, the image forming apparatus 1 includes a box-shaped apparatus main body 2. At an upper end portion of the apparatus main body 2, an ejected sheet tray 3 is provided.

In a center portion of the apparatus main body 2, an intermediate transferring belt 4 is stored. At a right end side of the intermediate transferring belt 4, a cleaning mechanism 5 is provided.

In the center portion of the apparatus main body 2, four image forming parts 6 are stored below the intermediate transferring belt 4. The four image forming parts 6 correspond to toners (developers) of black, cyan, magenta and yellow. Each image forming part 6 includes a photosensitive drum 7, a charger 8, a development device 9, a primary transferring roller 10, a cleaning device 11 and a static eliminator (not shown).

In a lower portion of the apparatus main body 2, an exposure device 12 is stored. In a lower end portion of the apparatus main body 2, a sheet feeding cassette 13 is stored. In the sheet feeding cassette 13, a sheet S is stored.

Along a left side portion of the apparatus main body 2, a conveyance path P for the sheet S is provided from the sheet feeding cassette 13 to the ejected sheet tray 3. At a midstream portion of the conveyance path P, a secondary transferring roller 14 is provided. At a downstream portion of the conveyance path P, a fixing device 15 is provided.

In an upper portion of the apparatus main body 2, four first attachment parts 16 are provided. To the four first attachment parts 16, four toner containers 17 (an example of toner cases) are detachably attached. The four toner containers 17 store fresh toners of black, cyan, magenta and yellow, respectively. In a right lower portion of the apparatus main body 2, a second attachment part 18 is provided. To the second attachment part 18, a waste toner box 19 (an example of a toner case) is detachably attached. The waste toner box 19 stores a waste toner.

Next, an operation of the image forming apparatus 1 will be described.

When an instruction for printing start is inputted to the image forming apparatus 1, each image forming part 6 performs an image forming operation as follows. First, the charger 8 charges a surface of the photosensitive drum 7. Next, the exposure device 12 emits laser light (refer to a dotted line arrow in FIG. 1) to form an electrostatic latent image on the surface of the photosensitive drum 7. Then, the development device 9 develops the electrostatic latent image formed on the surface of the photosensitive drum 7. Thereby, a toner image is carried on the surface of the photosensitive drum 7. The toner image is primarily transferred on a surface of the intermediate transferring belt 4 by the primary transferring roller 10.

By performing the above image forming operation at each image forming part 6, a full color toner image is formed on the surface of the intermediate transferring belt 4. A toner remaining on the surface of the photosensitive drum 7 after the image forming operation is removed from the surface of the photosensitive drum 7 by the cleaning device 11, conveyed from the cleaning device 11 to the waste toner box 19 and then collected in the waste toner box 19.

The sheet S fed from the sheet feeding cassette 13 is conveyed to a downstream side along the conveyance path P, and enters a nip area between the intermediate transferring belt 4 and the secondary transferring roller 14. The secondary transferring roller 14 secondarily transfers the full color toner image formed on the surface of the intermediate transferring belt 4 to the sheet S. The waste toner remaining on the surface of the intermediate transferring belt 4 after the secondary transferring is removed by the cleaning mechanism 5, conveyed from the cleaning mechanism 5 to the waste toner box 19 and then collected in the waste toner box 19.

The sheet S to which the full color toner image is secondarily transferred is further conveyed to the downstream side along the conveyance path P, and then enters the fixing device 15. The fixing device 15 fixes the full color toner image on the sheet S. The sheet S on which the full color toner image is fixed is ejected on the ejected sheet tray 3.

Next, each first attachment part 16 will be described.

The four first attachment parts 16 have the same configuration, and one of the four first attachment parts 16 will be explained in the following description.

Figure 2:
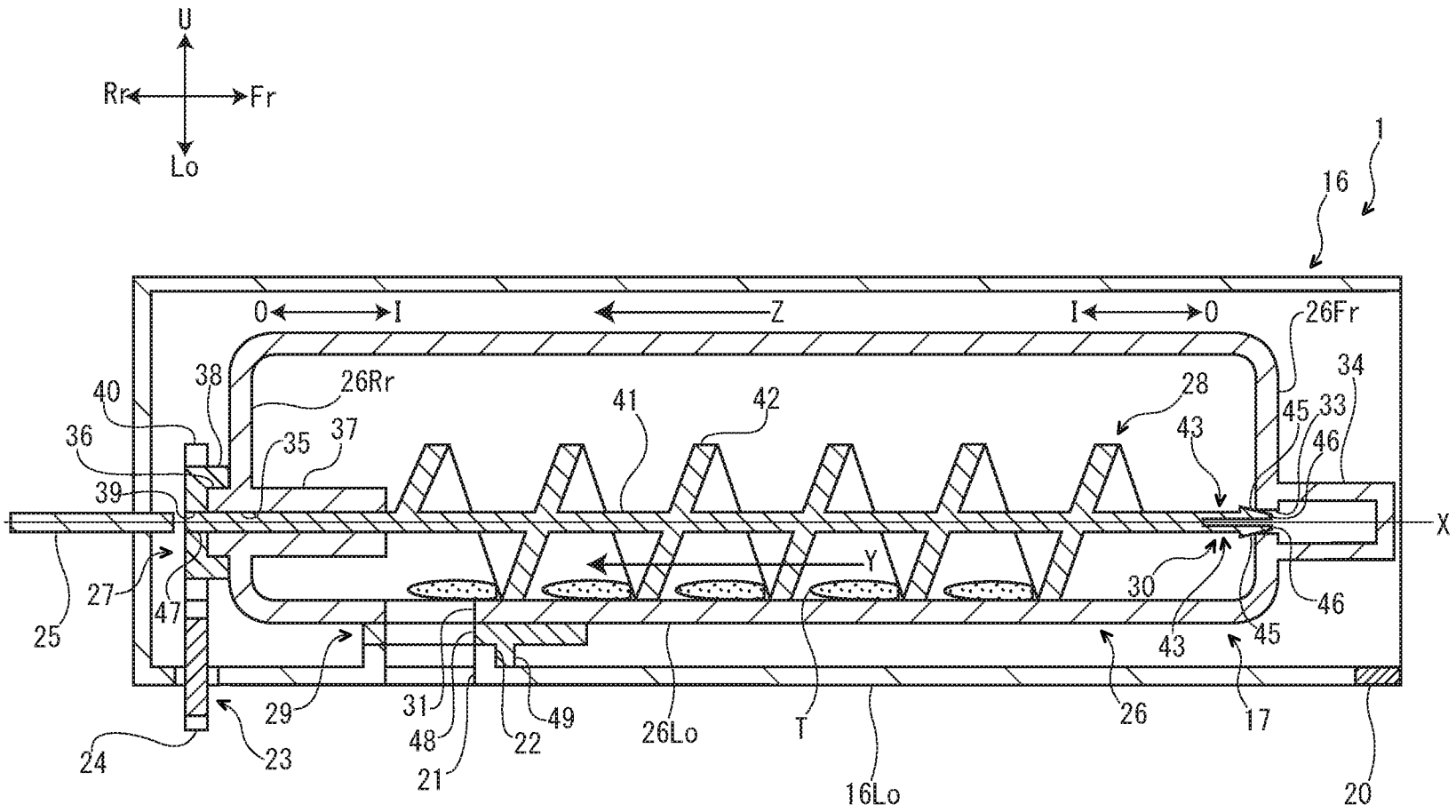
FIG. 2 is a sectional view showing a state where a conveying screw is in a coupling position, in the image forming apparatus according to the first embodiment of the present disclosure.
Figure 3:
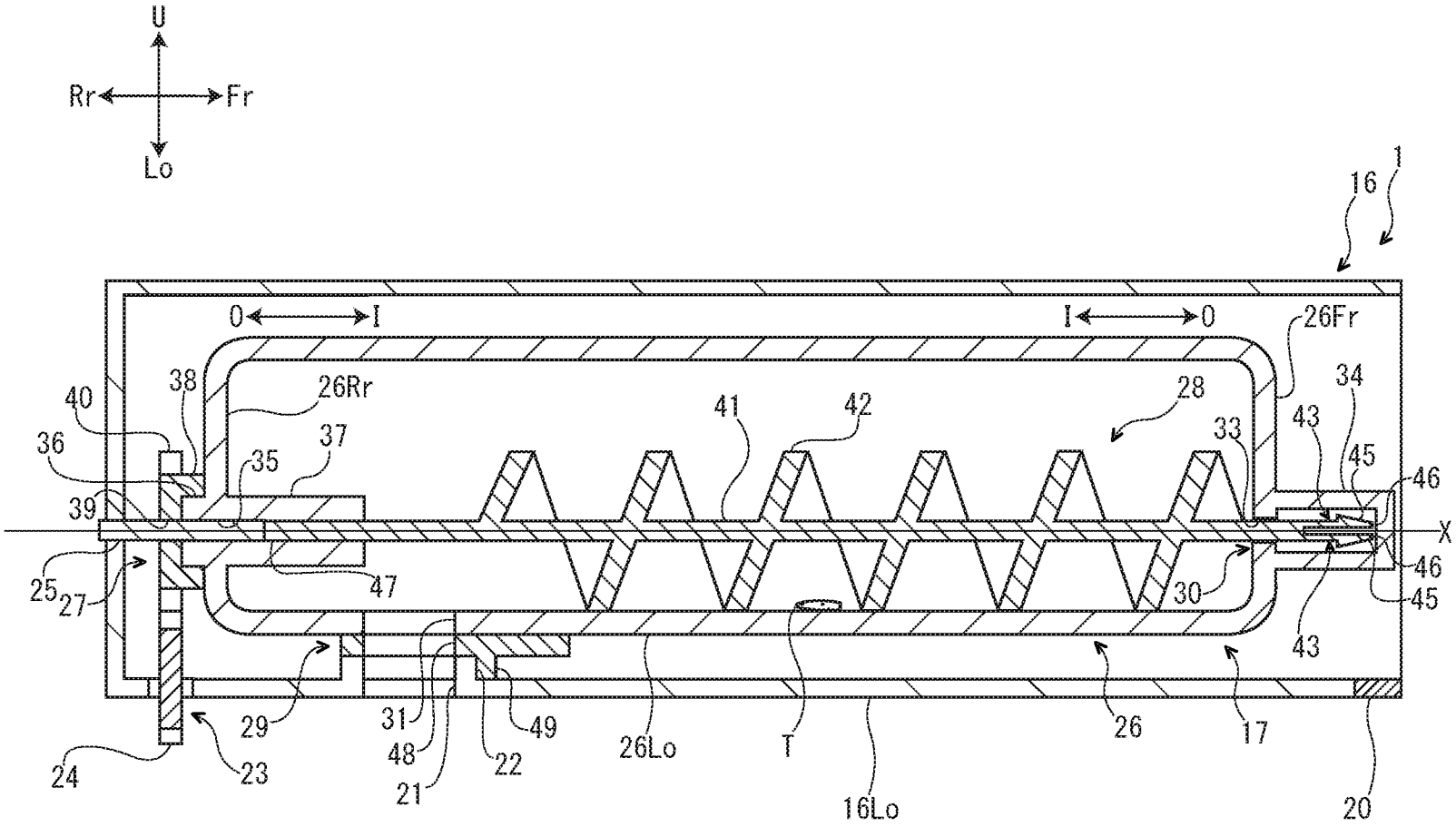
FIG. 3 is a sectional view showing a state where the conveying screw is in a release position, in the image forming apparatus according to the first embodiment of the present disclosure.

With reference to FIG. 2 and FIG. 3, the first attachment part 16 has a cylindrical shape elongated in a front-and-rear direction. To the first attachment part 16, the toner container 17 is detachably attached along an attachment direction from the front side to the rear side (refer to an arrow Z in FIG. 2).

At a front end portion of a lower plate 16Lo of the first attachment part 16, a position detecting part 20 is provided. At a rear portion of the lower plate 16Lo of the first attachment part 16, a replenishment port 21 is provided. The replenishment port 21 is communicated with an inside of the development device 9 of the image forming part 6 (refer to FIG. 1) through a replenishment pipe (not shown). On an upper face of the lower plate 16Lo of the first attachment part 16, an engagement piece 22 is protruded around the replenishment port 21.

At a rear portion of the first attachment part 16, a drive member 23 is rotatably provided. Around an outer circumferential face of the drive member 23, a drive gear 24 is provided. At a rear end portion of the first attachment part 16, an operation member 25 is provided. The operation member 25 is movable along the front-and-rear direction between a non-operative position (refer to FIG. 2) and an operative position (refer to FIG. 3).

Next, the toner container 17 will be described.

The toner containers 17 have the same configuration, and one of the toner containers 17 will be explained in the following description. An arrow I suitably marked in each figure shows an inside in the front-and-rear direction (a side close to a center of the toner container 17 in the front-and-rear direction). An arrow O suitably marked in each figure shows an outside in the front-and-rear direction (a side away from the center of the toner container 17 in the front-and-rear direction).

With reference to FIG. 2 and FIG. 3, the toner container 17 is mainly constituted of a case main body 26, a transmitting member 27 arranged at a rear end side of the case main body 26, a conveying screw 28 (an example of a conveying member) stored in the case main body 26 and a shutter 29 arranged at a lower end side of the case main body 26.

The case main body 26 of the toner container 17 has a box-shape elongated in the front-and-rear direction. Inside the case main body 26, a fresh toner T (hereinafter, called "a toner T" simply) is stored. A lower wall 26Lo of the case main body 26 is curved downward in an arc shape. At a rear portion of the lower wall 26Lo, a discharge port 31 for the toner T is provided.

At a lower portion of a front end wall 26Fr (one end wall in the front-and-rear direction) of the case main body 26, a circular first through hole 33 is provided. On a lower portion of a front face (a face at the outside in the front-and-rear direction) of the front end wall 26Fr, a box-shaped housing part 34 is protruded so as to cover the first through hole 33 from the front side (the outside in the front-and-rear direction).

At a lower portion of a rear end wall 26Rr (the other end wall in the front-and-rear direction) of the case main body 26, a circular second through hole 35 is provided. On a lower portion of a rear face (a face at the outside in the front-and-rear direction) of the rear end wall 26Rr, an outer cylindrical part 36 is protruded from an outer circumference of the second through hole 35 to the rear side (the outside in the front-and-rear direction). On a lower portion of a front face (a face at the inside in the front-and-rear direction) of the rear end wall 26Rr, an inner cylindrical part 37 is protruded from an outer circumference of the second through hole 35 to the front side (the inside in the front-and-rear direction).

With reference to FIG. 2 and FIG. 3, the transmitting member 27 of the toner container 17 is arranged at the rear side (the outside in the front-and-rear direction) of the rear end wall 26Rr of the case main body 26. That is, the transmitting member 27 is arranged outside the case main body 26.

Figure 4:
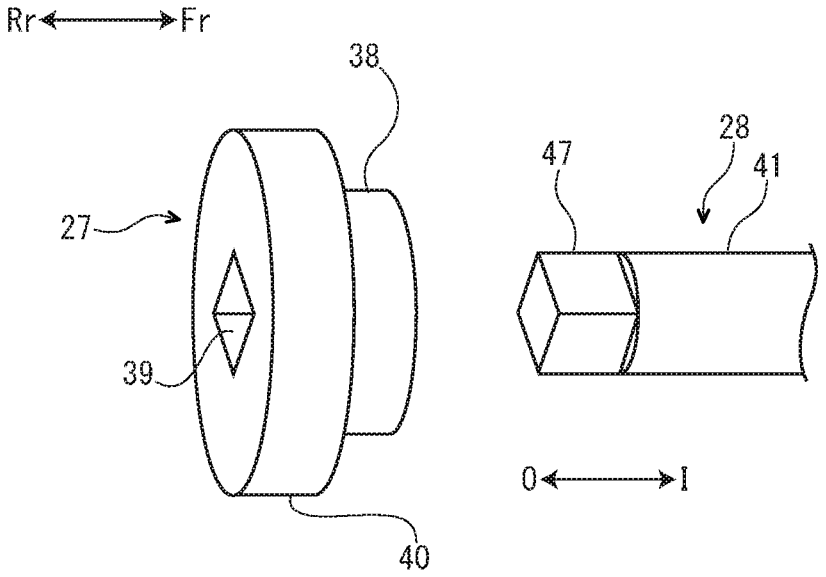
FIG. 4 is a perspective view showing a transmitting member and a conveying shaft of the conveying screw, in a toner case according to the first embodiment of the present disclosure.

With reference to FIG. 2 to FIG. 4, at a front portion (a portion at the inside in the front-and-rear direction) of the transmitting member 27, an annular mounting piece 38 is provided. The mounting piece 38 is mounted around an outer circumference of the outer cylindrical part 36 of the rear end wall 26Rr of the case main body 26. Thereby, the transmitting member 27 is rotatably supported by the rear end wall 26Rr of the case main body 26.

In an inner circumferential face of a rear portion (a portion at the outside in the front-and-rear direction) of the transmitting member 27, a square-column shaped fitting hole 39 is provided. Around an outer circumferential face of the rear portion of the transmitting member 27, a transmission gear 40 is provided. The transmission gear 40 is meshed with the drive gear 24 of the drive member 23. Thereby, the transmitting member 27 is connected to the drive member 23.

With reference to FIG. 2 and FIG. 3, the conveying screw 28 of the toner container 17 is rotated around a rotation axis X extending along the front-and-rear direction. That is, in the present embodiment, the front-and-rear direction is a rotation axis direction of the conveying screw 28. The conveying screw 28 is movable with respect to the case main body 26 and the transmitting member 27 along the front-and-rear direction between a coupling position (refer to FIG. 2) and a release position (refer to FIG. 3). Hereinafter, a configuration of the conveying screw 28 will be described based on a state where the conveying screw 28 is in the coupling position (refer to FIG. 2).

The conveying screw 28 includes a conveying shaft 41 extending linearly along the front- and rear direction and a spiral conveying blade 42 provided around an outer circumference of the conveying shaft 41.

Figure 5:
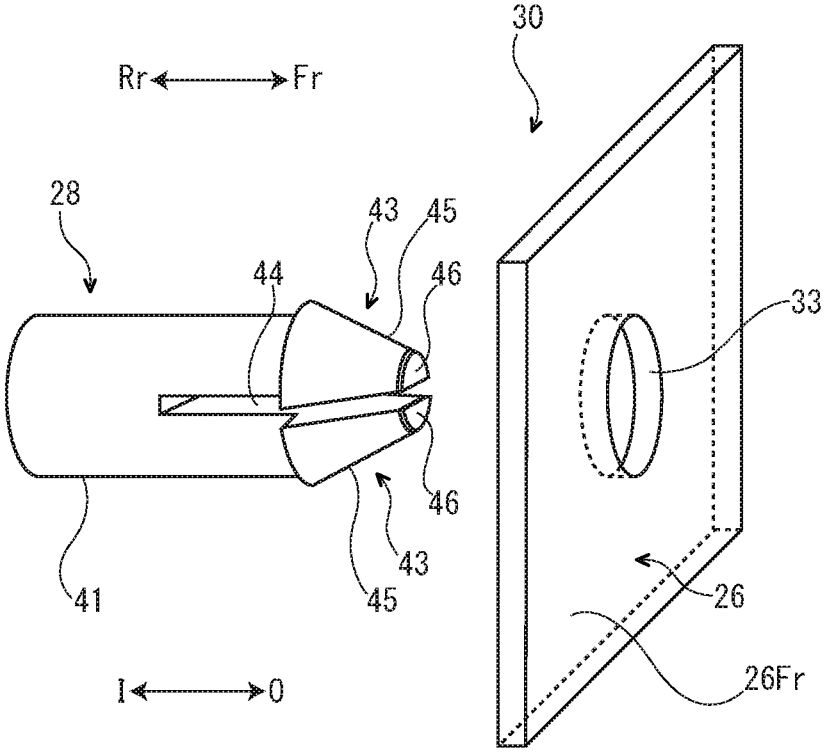
FIG. 5 is a perspective view showing a stopper mechanism, in the toner case according to the first embodiment of the present disclosure.

With reference to FIG. 2 and FIG. 5, at a front end portion (one end portion in the front-and-rear direction) of the conveying shaft 41 of the conveying screw 28, a pair of hooks 43 is provided. The pair of hooks 43 constitutes a stopper mechanism 30 together with the front end wall 26Fr of the case main body 26. Between the hooks 43, a slit groove 44 is provided along the front-and-rear direction. At a front end portion (an end portion at the outside in the front-and-rear direction) of each hook 43, a protruded part is provided. An outer circumferential face of the protruded part 45 is tapered such that its outer diameter is decreased from the rear side (the inside in the front-and-rear direction) to the front side (the outside in the front-and-rear direction). The protruded part 45 is engaged with the first through hole 33 of the front end wall 26Fr of the case main body 26. Thereby, the front end portion of the conveying shaft 41 is rotatably supported by the front end wall 26Fr of the case main body 26. On a front end portion (an end portion at the outside in the front-and-rear direction) of the protruded part 45, a detected part 46 is fixed. The detected part 46 is formed by magnetic permeable material.

With reference to FIG. 2, a rear portion of the conveying shaft 41 of the conveying screw 28 is inserted into the second through hole 35, the outer cylindrical part 36 and the inner cylindrical part 37 of the rear end wall 26Rr of the case main body 26. Thereby, the rear portion of the conveying shaft 41 is rotatably supported by the rear end wall 26Rr of the case main body 26.

With reference to FIG. 2 and FIG. 4, at a rear end portion (the other end portion in the front-and-rear direction) of the conveying shaft 41 of the conveying screw 28, a square-column shaped fitting piece 47 is provided. The fitting piece 47 is protruded to the rear side (the outside in the front-and-rear direction) from the rear end wall 26Rr of the case main body 26, and fitted into the fitting hole 39 of the transmitting member 27. Thereby, the conveying screw 28 is coupled to the transmitting member 27.

The conveying blade 42 of the conveying screw 28 is formed integrally with the conveying shaft 41. A lower portion of an outer circumferential face of the conveying blade 42 faces the lower wall 26Lo of the case main body 26 via a predetermined clearance (for example, a clearance of about 1 mm).

With reference to FIG. 2 and FIG. 3, the shutter 29 of the toner container 17 is provided along a lower face of the lower wall 26Lo of the case main body 26. That is, the shutter 29 is arranged outside the case main body 26. The shutter 29 is moved along the front-and-rear direction to open and close the discharge port 31 of the case main body 26 from the lower side (the outside). An operation of the shutter 29 will be explained in detail in a fourth embodiment described later. In a rear portion of the shutter 29, a communication port 48 is provided. On a lower face of the shutter 29, a rib 49 is protruded around the communication port 48.

Next, a control system of the image forming apparatus 1 will be described.

Figure 6:
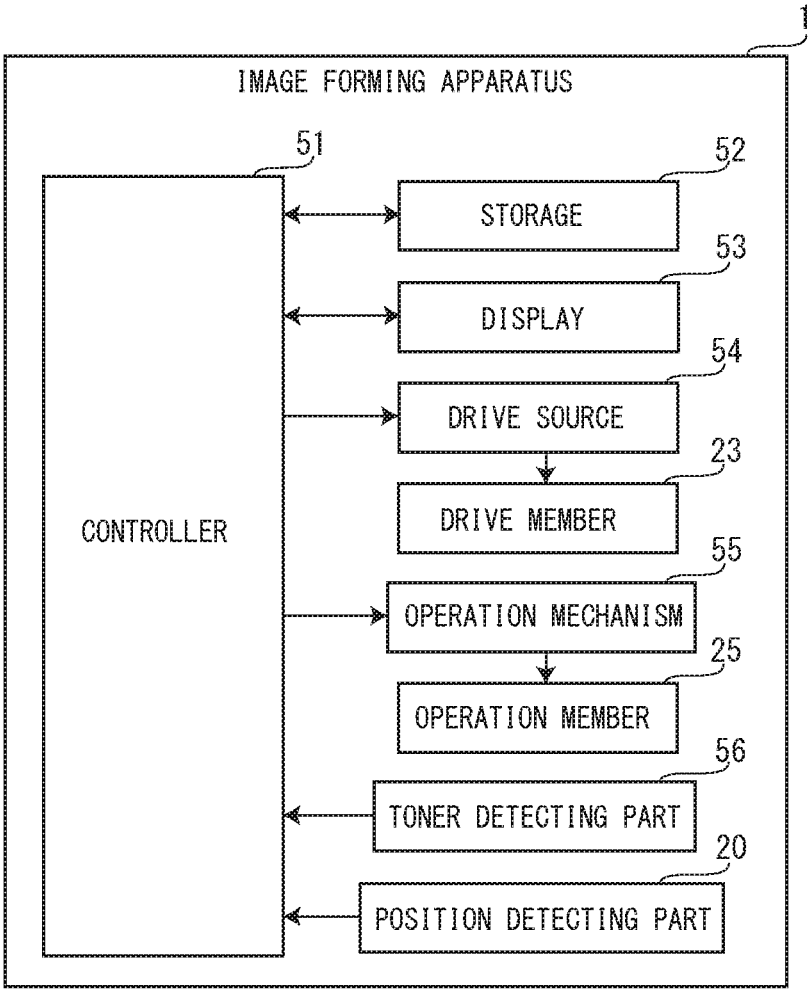
FIG. 6 is a block diagram showing a control system of the image forming apparatus according to the first embodiment of the present disclosure.

With reference to FIG. 6, the image forming apparatus 1 includes a controller 51. The controller 51 is constituted by a CPU (central processing unit), for example. The controller 51 is connected to each part (for example, each image forming part 6) of the image forming apparatus 1, and controls each part of the image forming apparatus 1.

The controller 51 is connected to a storage 52. The storage 52 includes a RAM (random access memory) and a ROM (read only memory).

The controller 51 is connected to a display 53 (an example of a notification part). The display 53 is constituted by a LCD (liquid crystal display), for example. The display 53 displays various screens (for example, an operation screen and an error message screen) based on a signal from the controller 51.

The controller 51 is connected to a drive source 54. The drive source 54 is constituted by a motor, for example. The drive source 54 is connected to the drive member 23, and rotates the drive member 23 based on a signal from the controller 51.

The controller 51 is connected to an operation mechanism 55. The operation mechanism 55 is connected to the operation member 25, and moves the operation member 25 between the non-operative position (refer to FIG. 2) and the operative position (refer to FIG. 3) based on a signal from the controller 51.

The controller 51 is connected to a toner detecting part 56. The toner detecting part 56 detects a concentration of the toner in the development device 9 of each image forming part 6 (refer to FIG. 1) and outputs the detected toner concentration to the controller 51.

The controller 51 is connected to the position detecting part 20. The position detecting part 20 is constituted by a magnetic sensor, for example. The position detecting part 20 detects a position of the conveying screw 28 based on a position of the detected part 46 fixed to the conveying screw 28 and outputs the detected position to the controller 51.

Next, a toner replenishment operation from the toner container 17 to the development device 9 of the image forming part 6 (hereinafter, called "a toner replenishment operation" simply) will be described.

With reference to FIG. 2, when the toner replenishment operation is performed, in a state where the conveying screw 28 is in the coupling position and the shutter 29 opens the discharge port 31 of the case main body 26, the drive source 54 rotates the drive member 23. When the drive member 23 is thus rotated, the rotation of the drive member 23 is transmitted to the conveying screw 28 by the transmitting member 27 and the conveying screw 28 is rotated integrally with the transmitting member 27.

When the conveying screw 28 is rotated as described above, the toner T stored in a lower space of the case main body 26 is conveyed to the discharge port 31 of the case main body 26 while slipping on an inclined face of the conveying blade 42. That is, the conveying screw 28 conveys the toner T in the case main body 26 to the discharge port 31 of the case main body 26 (refer to an arrow Y in FIG. 2). The toner T conveyed to the discharge port 31 of the case main body 26 is discharged outside the toner container 17 through the discharge port 31 of the case main body 26 and the communication port 48 of the shutter 29. The toner T discharged outside the toner container 17 is replenished to the development device 9 of the image forming part 6 through the replenishment port 21 of the first attachment part 16 and a replenishment pipe (not shown). Then, the toner replenishment operation is completed.

Next, movement of the conveying screw 28 will be described.

At the time of starting of the use of the toner container 17 (when the toner replenishment operation is not yet performed once), the conveying screw 28 is in the coupling position (refer to FIG. 2). In the state, the fitting piece 47 of the conveying shaft 41 of the conveying screw 28 is protruded to the rear side (the outside in the front-and-rear direction) from the rear end wall 26Rr of the case main body 26, and fitted into the fitting hole 39 of the transmitting member 27. That is, the conveying screw 28 is coupled to the transmitting member 27. Thereby, when the transmitting member 27 is rotated, the conveying screw 28 is rotated integrally with the transmitting member 27 to convey the toner T in the case main body 26 to the discharge port 31 of the case main body 26.

Additionally, in the state where the conveying screw 28 is in the coupling position (refer to FIG. 2), the detected part 46 fixed to each hook 43 of the conveying shaft 41 of the conveying screw 28 is positioned at a rear upper side of the position detecting part 20. Then, the position detecting part 20 detects that the conveying screw 28 is in the coupling position (refer to FIG. 2).

In the state where the conveying screw 28 is in the coupling position (refer to FIG. 2) as described above, when the image forming operation is performed at the image forming part 6, the toner detecting part 56 detects the concentration of the toner in the development device 9 of the image forming part 6, and outputs the detected toner concentration to the controller 51. When the toner concentration detected by the toner detecting part 56 is equal to or larger than a predetermined threshold value, the controller 51 determines that the case main body 26 is not in a toner empty state. In this case, the operation mechanism 55 holds the operation member 25 at the non-operative position (refer to FIG. 2) to keep the conveying screw 28 at the coupling position (refer to FIG. 2).

On the other hand, when the toner concentration detected by the toner detecting part 56 is less than the threshold value, the toner replenishment operation is performed. When the toner concentration detected by the toner detecting part 56 becomes equal to or larger than the threshold value after the toner replenishment operation is performed, the controller 51 determines that the case main body 26 is not in the toner empty state. In this case, the operation mechanism 55 holds the operation member 25 at the non-operative position (refer to FIG. 2) to keep the conveying screw 28 at the coupling position (refer to FIG. 2).

On the other hand, when the toner concentration detected by the toner detecting part 56 is yet less than the threshold value even after the toner replenishment operation is performed, the controller 51 determines that the case main body 26 is in the toner empty state. In this case, the operation mechanism. 55 moves the operation member 25 from the non-operative position (refer to FIG. 2) to the operative position (refer to FIG. 3). Then, the operation member 25 presses the fitting piece 47 of the conveying shaft 41 of the conveying screw 28 to the front side so as to move the conveying screw 28 from the coupling position (refer to FIG. 2) to the release position (refer to FIG. 3) toward the front side (an upstream side in a conveying direction of the toner by the conveying screw 28). Then, the fitting piece 47 is retracted into the inner cylindrical part 37 of the rear end wall 26Rr of the case main body 26 to release the fitting of the fitting piece 47 into the fitting hole 39 of the transmitting member 27. That is, the coupling of the conveying screw 28 to the transmitting member 27 is released. Then, even if the transmitting member 27 is rotated, the conveying screw 28 is not rotated to inhibit the conveyance of the toner T by the conveying screw 28.

Additionally, as the conveying screw 28 is moved from the coupling position (refer to FIG. 2) to the release position (refer to FIG. 3) as described above, each hook 43 of the conveying shaft 41 of the conveying screw 28 passes through the first through hole 33 of the front end wall 26Fr of the case main body 26 while deformed inwardly in a radial direction, and then elastically returned outwardly in the radial direction to be stored in the housing part 34 of the front end wall 26Fr of the case main body 26. Then, even if the operator tries to move the conveying screw 28 from the release position (refer to FIG. 3) to the coupling position (refer to FIG. 2) from the outside of the case main body 26, the protruded part 45 of each hook 43 interferes with the front end wall 26Fr of the case main body 26 so that the conveying screw 28 cannot be moved from the release position (refer to FIG. 3) to the coupling position (refer to FIG. 2). As described above, by passing each hook 43 through the first through hole 33 provided in the front end wall 26Fr of the case main body 26, the movement of the conveying screw 28 from the release position (refer to FIG.

3) to the coupling position (refer to FIG. 2) is restricted. That is, the stopper mechanism 30 which includes the front end wall 26Fr of the case main body 26 and each hook 43 restricts the movement of the conveying screw 28 from the release position (refer to FIG. 3) to the coupling position (refer to FIG. 2).

Additionally, when the conveying screw 28 is moved from the coupling position (refer to FIG. 2) to the release position (refer to FIG. 3) as described above and each hook 43 of the conveying shaft 41 of the conveying screw 28 is stored in the housing part 34 of the front end wall 26Fr of the case main body 26, the detected part 46 fixed to each hook 43 is positioned just above the position detecting part 20. Then, the position detecting part 20 detects that the conveying screw 28 is in the release position (refer to FIG. 3), and the display 53 displays a notification screen which notifies the user that the toner replenishment operation is restricted.

As described above, the conveying screw 28 of the present embodiment is movable along the front-and-rear direction between the coupling position where the conveying screw 28 is coupled to the transmitting member 27 and the release position where the coupling of the conveying screw 28 to the transmitting member 27 is released. Thereby, by moving the conveying screw 28 from the coupling position to the release position, even if an operator rotates the transmitting member 27 accidentally when he collects the used toner container 17, the rotation of the transmitting member 27 is not transmitted to the conveying screw 28 to restrict the rotation of the conveying screw 28. Accordingly, it becomes possible to restrict the toner T slightly remaining in the case main body 26 from being conveyed to the discharge port 31 of the case main body 26 by the conveying screw 28 so that a leakage of the toner from the discharge port 31 of the case main body 26 can be surely prevented.

Additionally, the toner container 17 includes the stopper mechanism 30 which restricts the movement of the conveying screw 28 from the release position to the coupling position. Accordingly, it becomes possible to restrict the conveying screw 28 from being returned from the release position to the coupling position accidentally and to keep the performance to prevent the leakage of the toner from the discharge port 31 of the case main body 26.

Additionally, the image forming apparatus 1 includes the toner container 17 and the first attachment part 16 to which the toner container 17 is detachably attached. Accordingly, it becomes possible to provide the image forming apparatus 1 including the toner container 17 capable of preventing the leakage of the toner from the discharge port 31 of the case main body 26 surely.

Additionally, the image forming apparatus 1 includes the operation member 25 which moves the conveying screw 28 from the coupling position to the release position, and the operation member 25 is provided at the first attachment part 16. Accordingly, there is no need of the work to move the conveying screw 28 from the coupling position to the release position manually so that it becomes possible to inhibit the operator's body and clothing from being contaminated with the toner.

Additionally, when the position detecting part 20 detects that the conveying screw 28 is in the release position, the display 53 displays the notification message which notifies the user that the toner replenishment operation is restricted. Accordingly, the user can recognize that the toner replenishment operation is restricted, and it becomes possible to avoid a situation where the toner container 17 of which the conveying screw 28 is in the release position is accidentally attached to the first attachment part 16.

Additionally, in the present embodiment, the fitting position of the fitting piece 47 of the conveying shaft 41 of the conveying screw 28 into the fitting hole 39 of the transmitting member 27 is exposed to the outside of the toner container 17. Accordingly, it becomes possible to check visually whether the fitting piece 47 is fitted into the fitting hole 39 or not, that is, whether the toner replenishment operation is enable or not.

In the present embodiment, the toner case is used as the toner container 17 storing the fresh toner. On the other hand, in the other embodiments, the toner case may be used as the waste toner box 19 storing the waste toner. By applying the present disclosure to the toner case used as the waste toner box 19, it becomes possible to prevent the leakage of the waste toner from the discharge port 31 of the case main body 26 surely.

Additionally, in the other embodiments, after the use of the toner case as the toner container 17 storing the fresh toner is finished, the toner case may be used as the waste toner box 19 storing the waste toner. In a case where the above using method is applied, the conveying screw 28 is not made to be moved from the coupling position to the release position at a stage where the case main body 26 of the toner container 17 is in the toner empty state and is made to be moved from the coupling position to the release position at a stage where the case main body 26 of the waste toner box 19 is filled with the toner, preferably. Thereby, it becomes possible to avoid a situation where the waste toner box 19 storing the waste toner is accidentally attached to the first attachment part 16.

In the present embodiment, the conveying screw 28 including the spiral conveying blade 42 is used as the conveying member. On the other hand, in the other embodiments, a member, such as a conveying paddle including a film-shaped conveying blade, may be used as the conveying member other than the conveying screw.

In the present embodiment, the image forming apparatus 1 is a color printer. On the other hand, in the other embodiments, the image forming apparatus 1 may be a monochrome printer, a copying machine, a facsimile and a multifunctional peripheral (an image forming apparatus multiply including a print function, a copying function and a facsimile function).

A Second Embodiment

Figure 7:
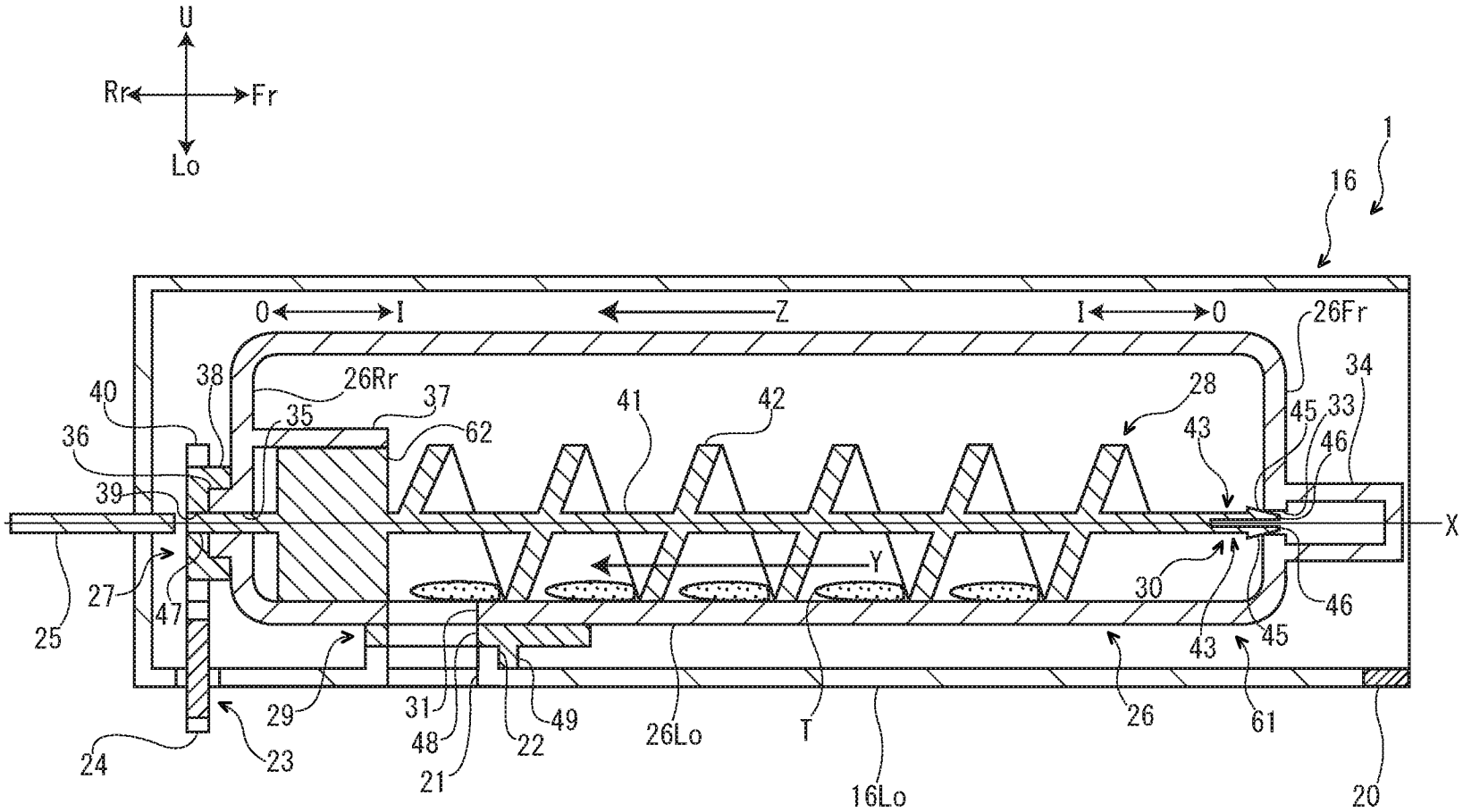
FIG. 7 is a sectional view showing the state where the conveying screw is in the coupling position, in the image forming apparatus according to a second embodiment of the present disclosure.
Figure 8:
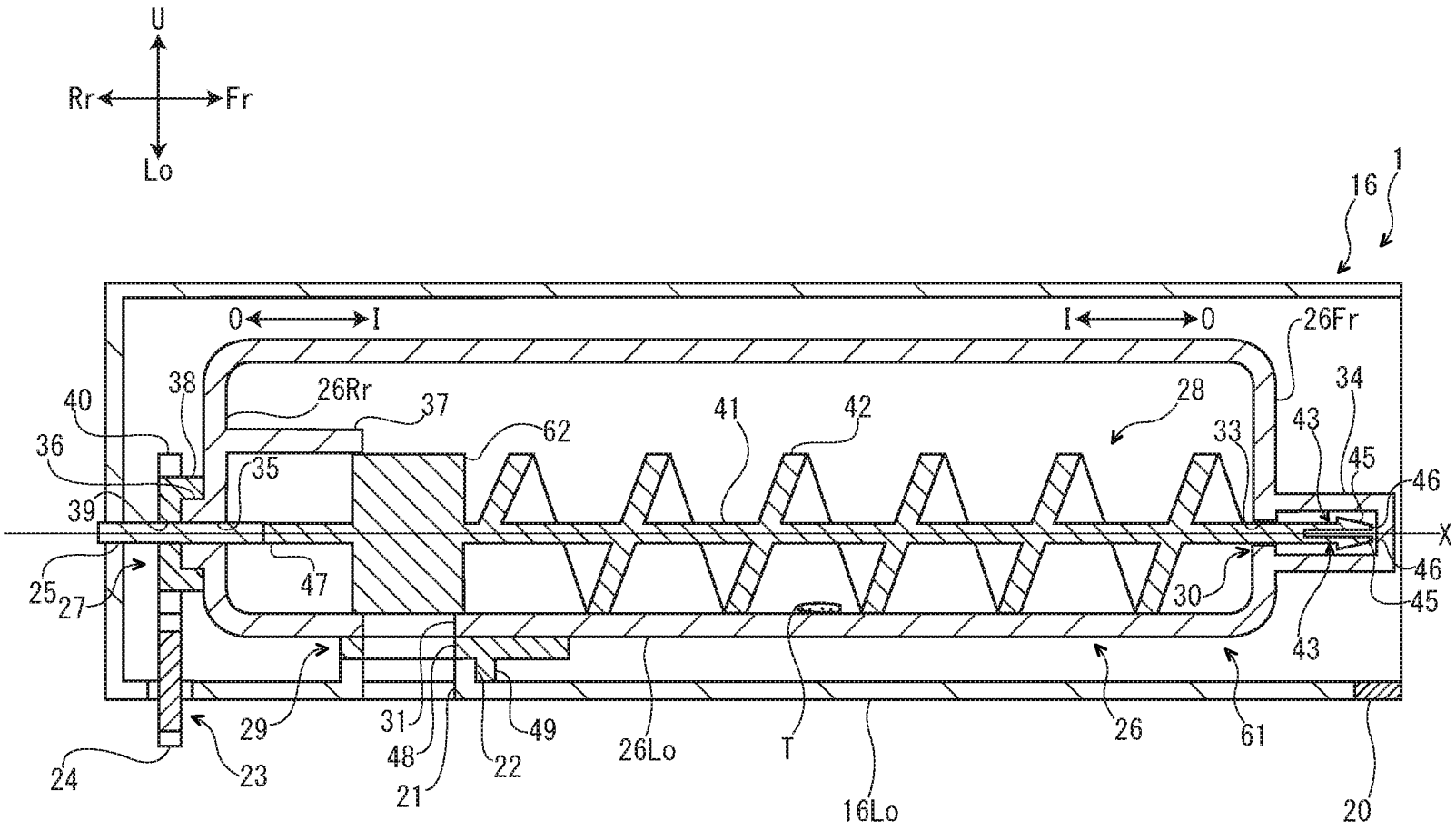
FIG. 8 is a sectional view showing the state where the conveying screw is in the release position, in the image forming apparatus according to the second embodiment of the present disclosure.

Hereinafter, with reference to FIG. 7 and FIG. 8, the toner container 61 (an example of a toner case) according to a second embodiment of the present disclosure will be described. The same explanation as the toner container 17 of the first embodiment will be omitted.

The conveying screw 28 of the toner container 61 includes an open-and-close part 62 in addition to the conveying shaft 41 and the conveying blade 42. The open-and-close part 62 has an annular shape, and is provided around an outer circumference of the rear portion of the conveying shaft 41. The open-and-close part 62 is fitted into an inner circumference of the inner cylindrical part 37 of the case main body 26, and is rotatably supported by the inner cylindrical part 37 of the case main body 26. A lower portion of the open-and-close part 62 comes into contact with an upper face (an inner face) of the lower wall 26Lo of the case main body 26.

In the toner container 61 having the above configuration, in the state where the conveying screw 28 is in the coupling position (refer to FIG. 7), the open-and-close part 62 of the conveying screw 28 is arranged at a rear side (the downstream side in the conveying direction of the toner by the conveying screw 28) from the discharge port 31 of the case main body 26, and is not overlapped with the discharge port 31 of the case main body 26. That is, the open-and-close part 62 opens the discharge port 31 of the case main body 26. Thereby, when the conveying screw 28 is rotated, the toner T in the case main body 26 is conveyed to the discharge port 31 of the case main body 26 by the conveying screw 28 and then discharged through the discharge port 31 of the case main body 26.

On the other hand, when the conveying screw 28 is moved from the coupling position (refer to FIG. 7) to the release position (refer to FIG. 8) to the front side (the upstream side in the conveying direction of the toner by the conveying screw 28) in the same manner as the first embodiment, the open-and-close part 62 of the conveying screw 28 is also moved to the front side and overlapped with the discharge port 31 of the case main body 26 from the upper side (the inside). That is, the open-and-close part 62 closes the discharge port 31 of the case main body 26 from the upper side (the inside). Then, regardless of whether the conveying screw 28 rotates or not, it becomes possible to inhibit the toner slightly remaining in the case main body 26 from being discharged through the discharge port 31 of the case main body 26. Accordingly, it becomes possible to prevent the leakage of the toner from the discharge port 31 of the case main body 26 more surely.

A Third Embodiment

Hereinafter, with reference to FIG. 9 to FIG. 11, the toner container 71 (an example of a toner case) according to a third embodiment of the present disclosure will be described. The same explanation as the toner container 61 of the second embodiment will be omitted.

The toner container 71 includes a manipulation member 72 in addition to the case main body 26, the transmitting member 27, the conveying screw 28 (an example of the conveying member) and the shutter 29.

The manipulation member 72 is attached to a rear upper portion of the case main body 26. The manipulation member 72 is movable along the front-and-rear direction between a first manipulation position (refer to FIG. 9 and FIG. 11) and a second manipulation position (refer to FIG. 10).

The manipulation member 72 includes a manipulated part 73 extending along the front-and-rear direction and a pressing part 74 extending downward from a rear end portion of the manipulated part 73. The manipulated part 73 is provided along an upper face (an outer face) of an upper wall 26U of the case main body 26. That is, the manipulated part 73 is provided outside the case main body 26. The pressing part 74 is inserted into the inside of the case main body 26. A lower end portion of the pressing part 74 comes into contact with a rear face of the open-and-close part 62 (refer to the second embodiment) of the conveying screw 28.

Figure 9:
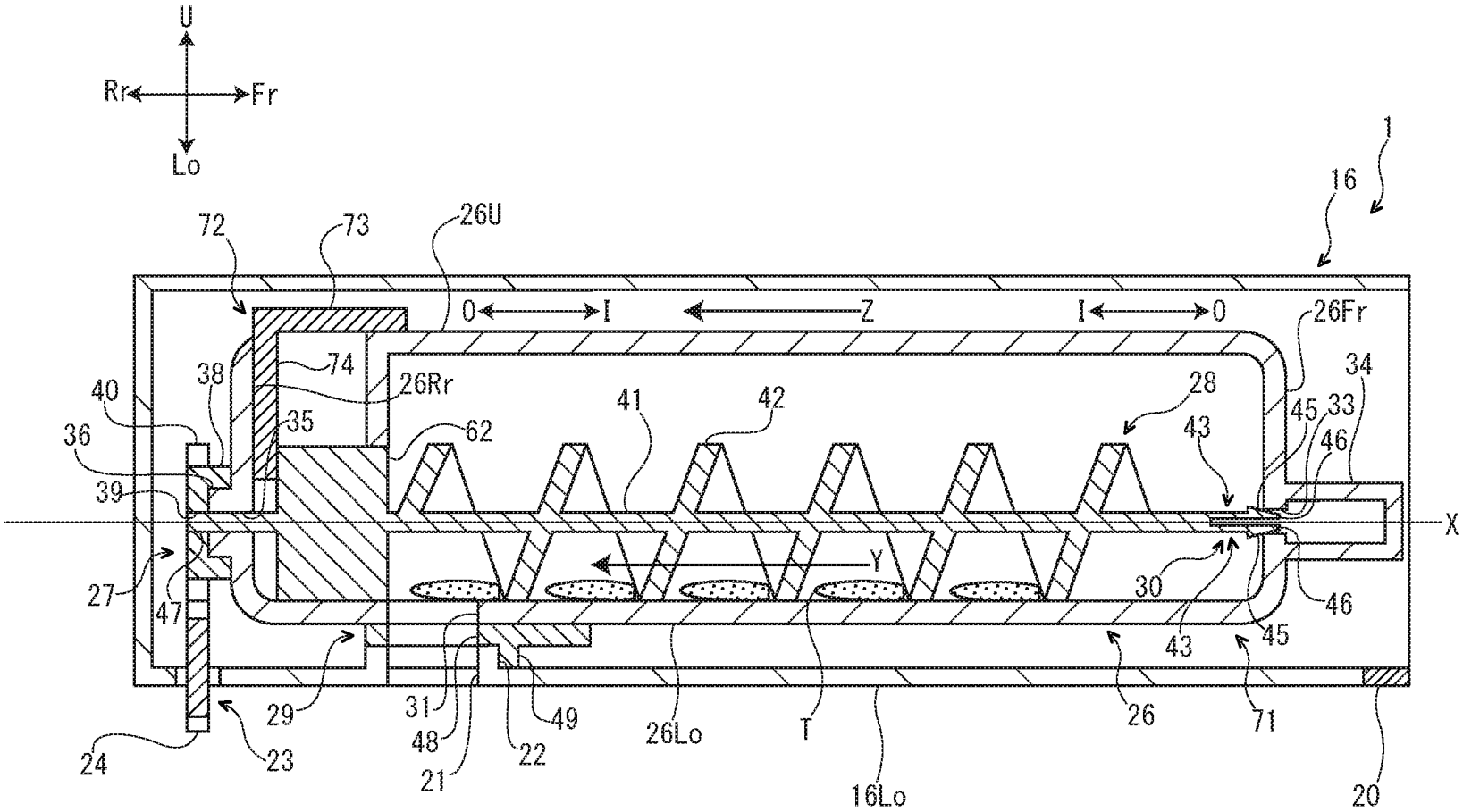
FIG. 9 is a sectional view showing a state where a manipulation member is in a first manipulation position and the conveying screw is in the coupling position, in the toner case according to a third embodiment of the present disclosure.

At the time of the starting of the use of the toner container 71 having the above configuration, the manipulation member 72 is in the first manipulation position and the conveying screw 28 is in the coupling position (refer to FIG. 9).

Figure 10:
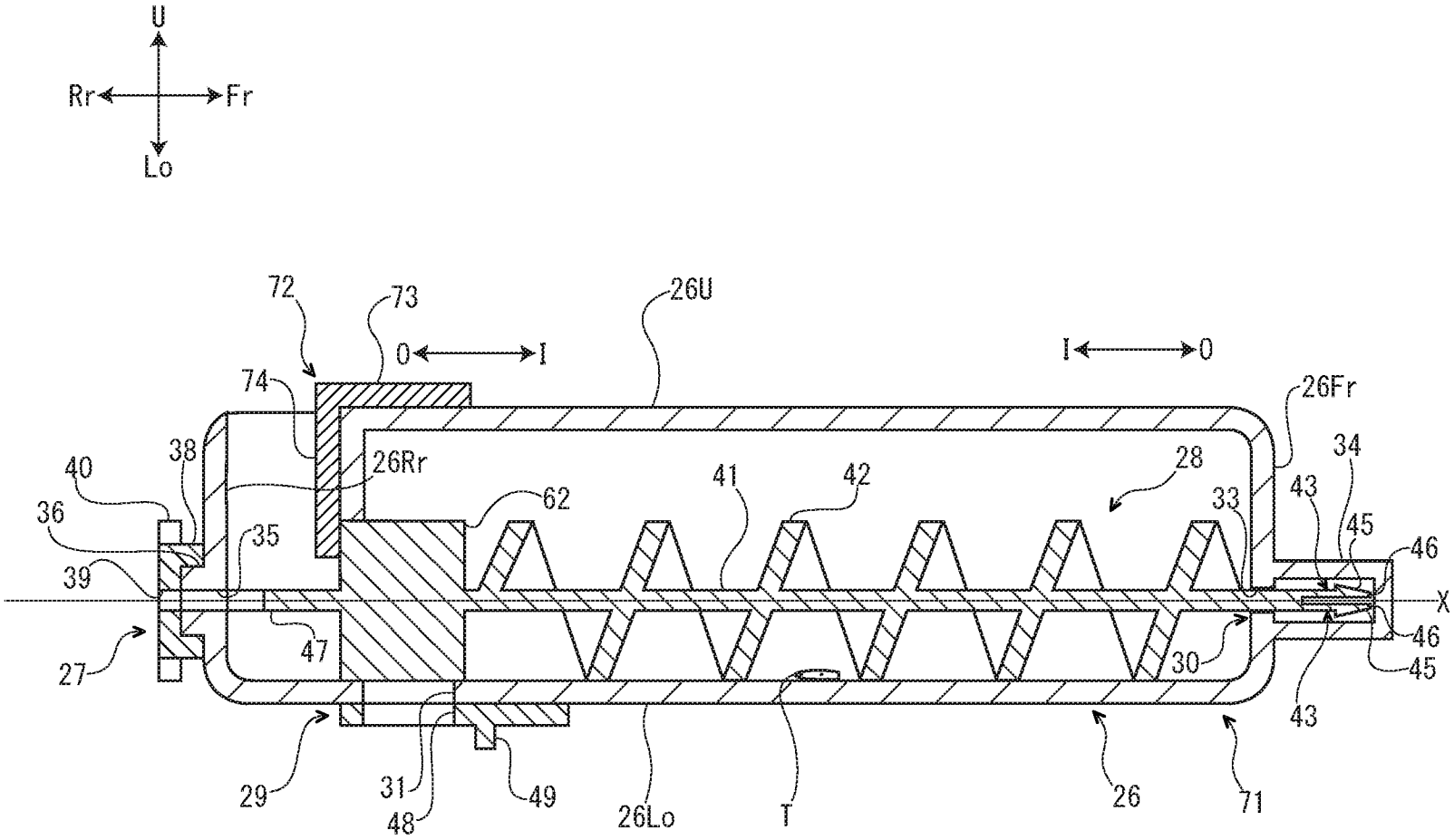
FIG. 10 is a sectional view showing a state where the manipulation member is in a second manipulation position and the conveying screw is in the release position, in the toner case according to the third embodiment of the present disclosure.

On the other hand, at the collection of the used toner container 71, the operator detaches the toner container 71 from the first attachment part 16 and manipulates the manipulated part 73 of the manipulation member 72 toward the front side so as to move the manipulation member 72 from the first manipulation position to the second manipulation position (refer to FIG. 10). Then, the pressing part 74 of the manipulation member 72 presses the open-and-close part 62 of the conveying screw 28 toward the front side so as to move the conveying screw 28 from the coupling position to the release position toward the front side (the upstream side in the conveying direction of the toner by the conveying screw 28).

In the present embodiment, as described above, with the operator's manipulation of the manipulation member 72, the conveying screw 28 is moved from the coupling position to the release position. Accordingly, the operation member 25 (refer to the first and second embodiments) which moves the conveying screw 28 from the coupling position to the release position is not required to be provided in the first attachment part 16 so that it becomes possible to make the configuration of the first attachment part 16 simple.

Figure 11:
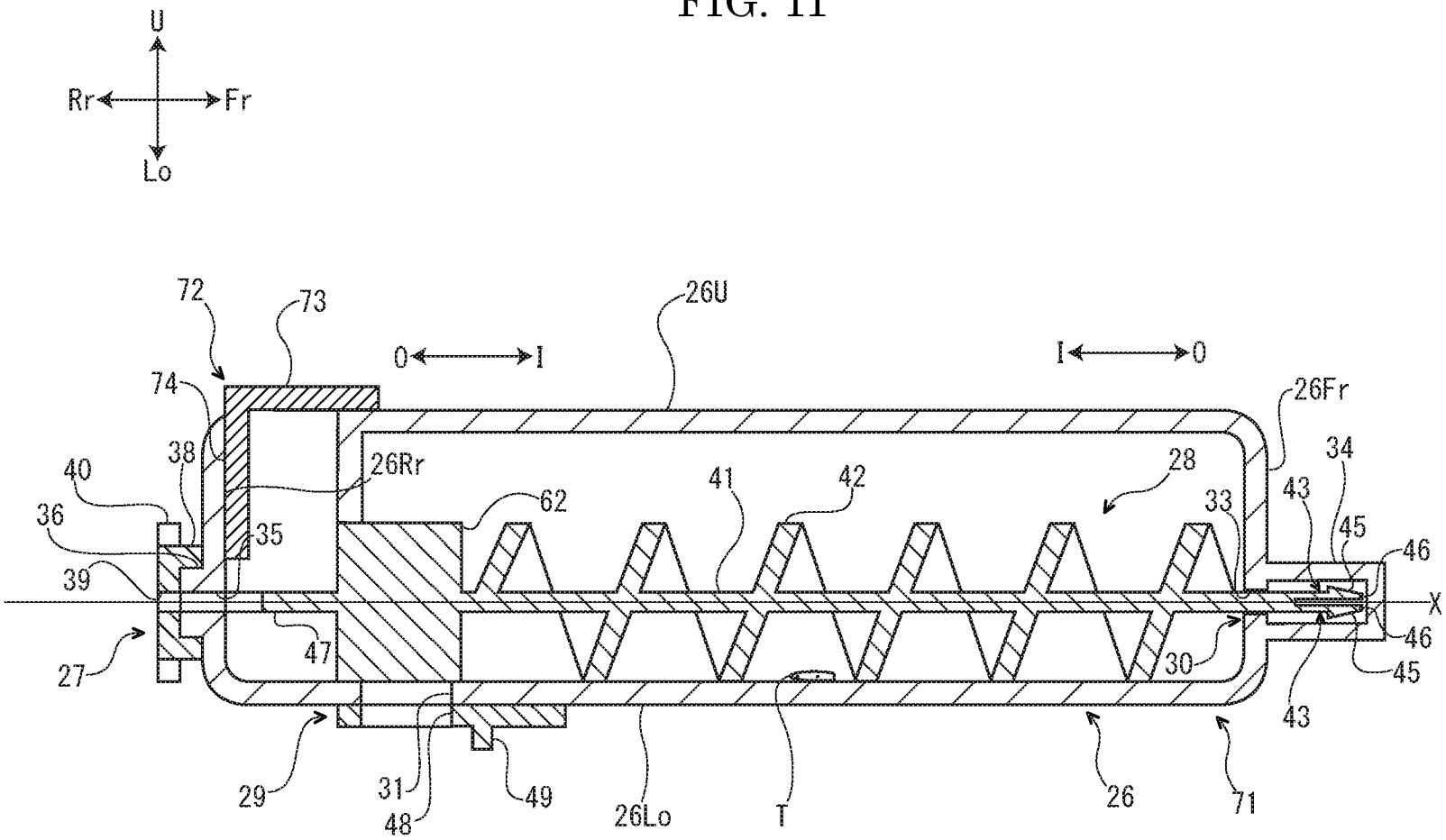
FIG. 11 is a sectional view showing a state where the manipulation member is in the first manipulation position and the conveying screw is in the release position, in the toner case according to the third embodiment of the present disclosure.

After the manipulation member 72 is moved from the first manipulation position to the second manipulation position as described above, when the operator manipulates the manipulated part 73 of the manipulation member 72 toward the rear side, the manipulation member 72 is moved from the second manipulation position to the first manipulation position (refer to FIG. 11). On the other hand, even if the manipulation member 72 is returned to the first manipulation position, the conveying screw 28 is not returned to the coupling position and kept at the release position (refer to FIG. 11). Accordingly, it becomes possible to keep the performance to prevent the leakage of the toner from the discharge port 31 of the case main body 26.

In the present embodiment, only the manipulated part 73 of the manipulation member 72 is provided outside the case main body 26. On the other hand, in the other embodiments, an entirety of the manipulation member 72 may be provided outside the case main body 26.

A Fourth Embodiment

Hereinafter, with reference to FIG. 12 to FIG. 14, the toner container 81 (an example of a toner case) according to a fourth embodiment of the present disclosure will be described. The same explanation as the toner container 61 of the second embodiment is omitted.

The toner container 81 includes the case main body 26, the transmitting member 27, the conveying screw 28 (an example of the conveying member) and the shutter 29.

Figure 13:
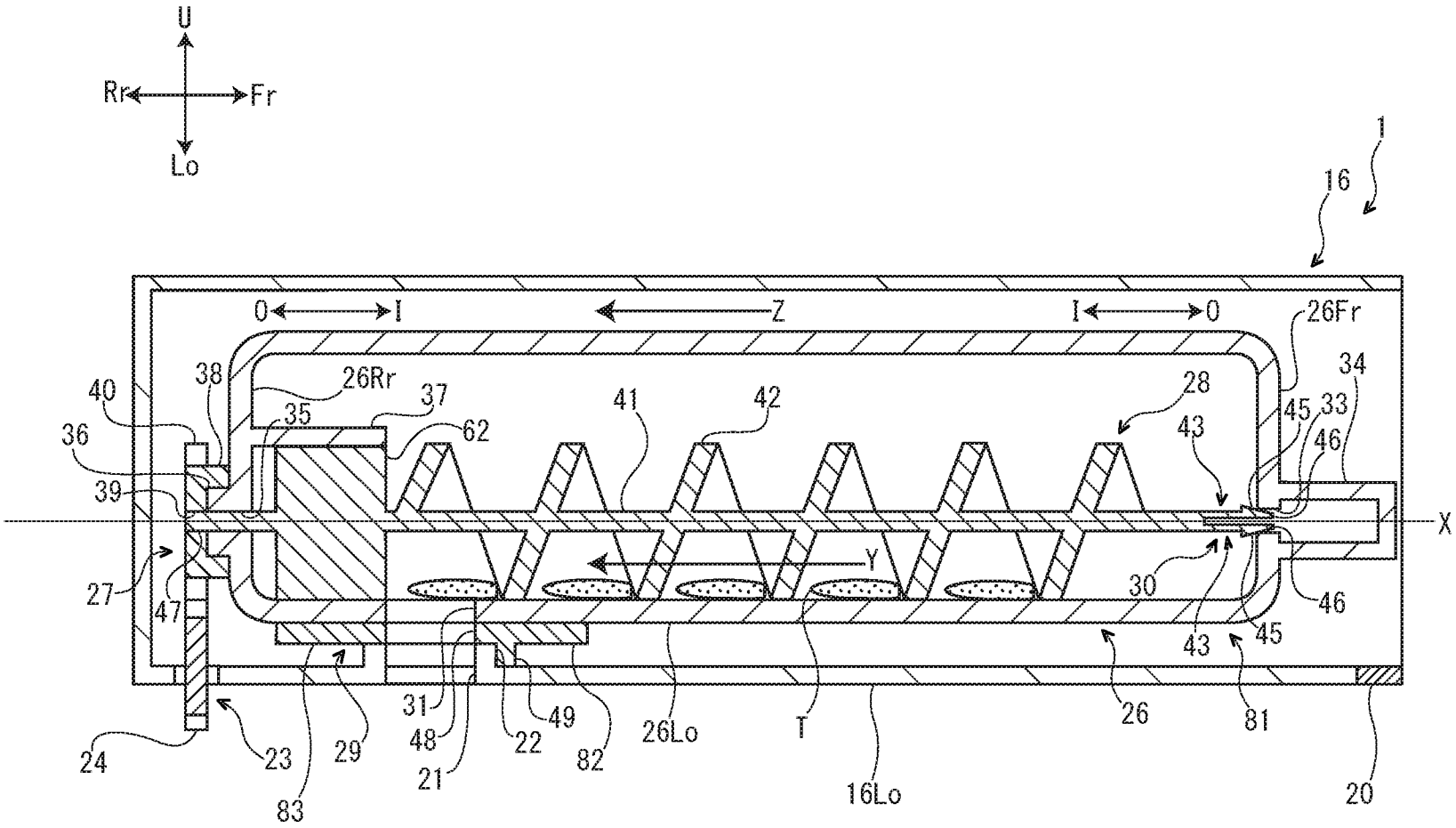
FIG. 13 is a sectional view showing a state where the shutter is in a second position, in the toner case according to the fourth embodiment of the present disclosure.
Figure 14:
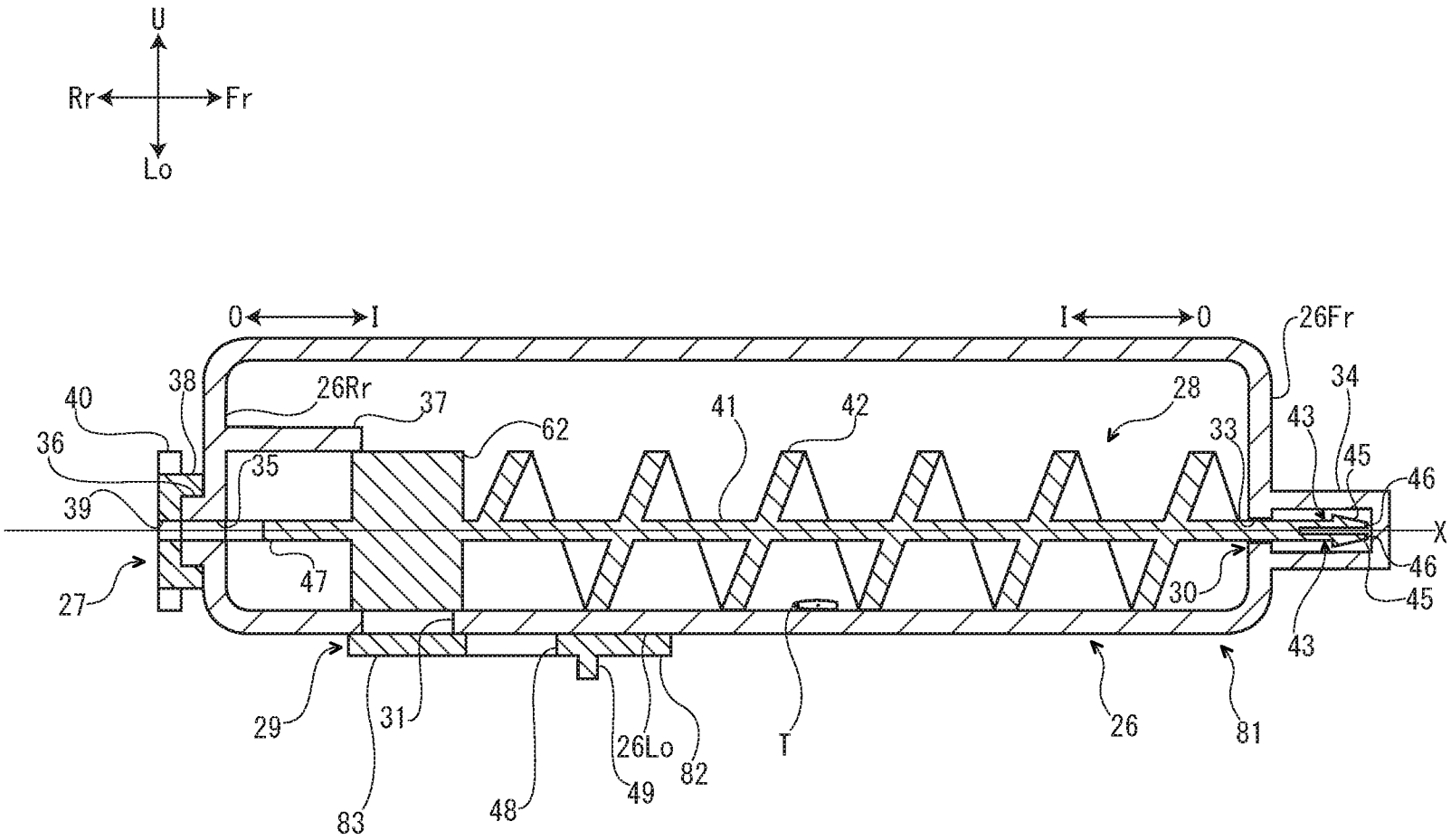
FIG. 14 is a sectional view showing a state where a shutter is in a third position, in the toner case according to the fourth embodiment of the present disclosure.

The shutter 29 is displaceable among a first position (refer to FIG. 12) and a second position (refer to FIG. 13) and a third position (refer to FIG. 14). The third position (refer to FIG. 14) is set at an opposite side of the first position (refer to FIG. 12) with respect to the second position (refer to FIG. 13).

In a state where the shutter 29 is in the first position (refer to FIG. 12), a first portion 82 (a portion at the front side of the communication port 48) of the shutter 29 is overlapped with the discharge port 31 of the case main body 26 from the lower side (the outside) to close the discharge port 31 of the case main body 26 by the shutter 29. In a state where the shutter 29 is in the second position (refer to FIG. 13), the communication port 48 of the shutter 29 is overlapped with the discharge port 31 of the case main body 26 from the lower side (the outside) to open the discharge port 31 of the case main body 26 by the shutter 29. In a state where the shutter is in the third position (refer to FIG. 14), a second portion 83 (a portion at the rear side of the communication port 48) of the shutter 29 is overlapped with the discharge port 31 of the case main body 26 from the lower side (the outside) to close the discharge port 31 of the case main body 26 by the shutter 29.

Figure 12:
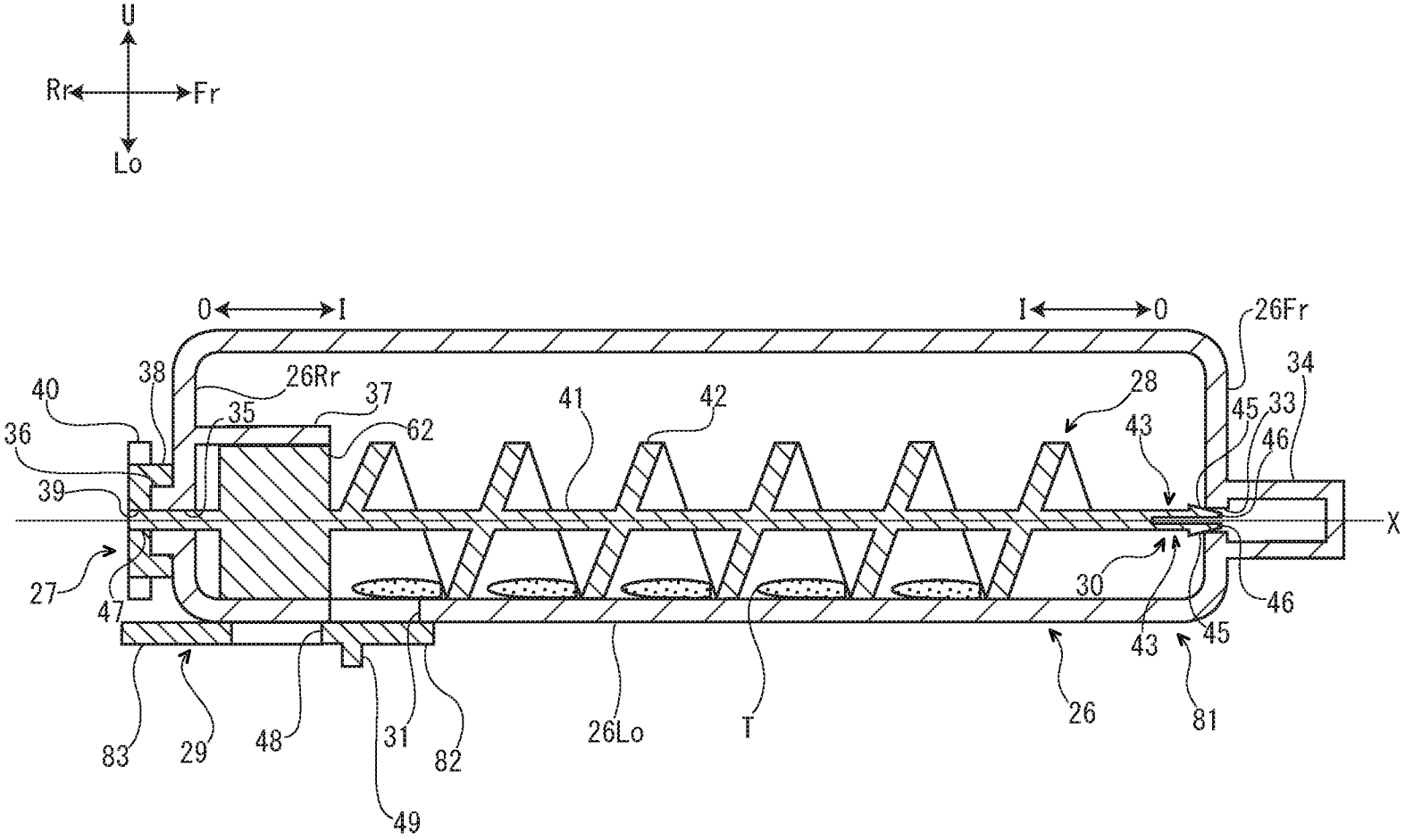
FIG. 12 is a sectional view showing a state where a shutter is in a first position, in the toner case according to a fourth embodiment of the present disclosure.

In a state before the toner container 81 is attached to the first attachment part 16 (a state before the starting of the use of the toner container 81), the shutter 29 is in the first position and the conveying screw 28 is in the coupling position (refer to FIG. 12).

On the other hand, at the time of the starting of the use of the toner container 81, when the toner container 81 is attached to the first attachment part 16, the rib 49 of the shutter 29 is engaged with the engagement piece 22 of the first attachment part 16 such that the shutter 29 is restricted from being moved to the rear side while the case main body 26 is moved to the rear side with respect to the shutter 29. Then, the shutter 29 is displaced from the first position to the second position with the conveying screw 28 kept at the coupling position (refer to FIG. 13).

When the toner container 81 is detached from the first attachment part 16 in the state where the shutter 29 is in the second position, the shutter 29 is displaced from the second position to the first position by biasing force of a coil spring (not shown) with the conveying screw 28 kept at the coupling position (refer to FIG. 12).

On the other hand, when the used toner container 81 is collected, the operator displaces the shutter 29 from the second position to the third position (refer to FIG. 14). Then, the shutter 29 presses the conveying screw 28 to the front side, and the conveying screw 28 is moved from the coupling position to the release position toward the front side (the upstream side in the conveying direction of the toner by the conveying screw 28).

In the present embodiment, as described above, with the displacement of the shutter 29 from the second position to the third position (with the operation of the shutter 29 to close the discharge port 31 of the case main body 26), the conveying screw 28 is moved from coupling position to the release position. Accordingly, when the used toner container 81 is collected, even if the operator displaces the shutter 29 accidentally, it becomes possible to prevent the leakage of the toner from the discharge port 31 of the case main body 26 surely.

The shutter 29 is displaceable among the first position and the second position and the third position. In the first position, the shutter 29 closes the discharge port 31 of the case main body 26 and positions the conveying screw 28 to the coupling position. In the second position, the shutter 29 opens the discharge port 31 of the case main body 26 and positions the conveying screw 28 to the coupling position. In the third position, the shutter 29 closes the discharge port 31 of the case main body 26 and positions the conveying screw 28 to the release position. Thereby, when the toner container 81 is detached and attached with respect to the first attachment part 16, by displacing the shutter 29 between the first position and the second position, it become possible to open and close the discharge port 31 of the case main body 26 while keeping the toner replenishment operation performable state. On the other hand, when the used toner container 81 is collected, by displacing the shutter 29 from the second position to the third position, it becomes possible to inhibit the leakage of the toner from the discharge port 31 of the case main body 26 surely.

In the present embodiment, the shutter 29 is displaced among the first position and the second position and the third position. That is, in the present embodiment, the shutter 29 is displaced among the three positions. On the other hand, in the other embodiments, the shutter 29 may be displaced between an open position (corresponding to "a second position" in the present embodiment) and a close position (corresponding to "a third position" in the present embodiment). In the open position, the shutter 29 opens the discharge port 31 of the case main body 26 and positions the conveying screw 28 to the coupling position. In the close position, the shutter 29 closes the discharge port 31 of the case main body 26 and positions the conveying screw 28 to the release position. That is, in the other embodiments, the shutter 29 may be displaced between the two positions.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A toner case comprising:

a case main body configured to store a toner and having a discharge port for the toner;

a conveying member configured to rotate around a rotation axis extending along a rotation axis direction and to convey the toner in the case main body to the discharge port; and a transmitting member configured to transmit rotation to the conveying member, wherein the conveying member is movable along the rotation axis direction with respect to the transmitting member between a coupling position where the conveying member is coupled to the transmitting member and a release position where a coupling of the conveying member to the transmitting member is released, and wherein the conveying member opens the discharge port in a state where the conveying member is in the coupling position, and the conveying member closes the discharge port in a state where the conveying member is in the release position.

2. The toner case according to claim 1, further comprising a stopper mechanism configured to restrict movement of the conveying member from the release position to the coupling position.

3. The toner case according to claim 2, wherein the stopper mechanism includes:

one end wall in the rotation axis direction of the case main body; and a hook provided in the conveying member, when the conveying member moves from the coupling position to the release position, the hook passes through a through hole provided in the one end wall to restrict the movement of the conveying member from the release position to the coupling position.

4. The toner case according to claim 3, wherein a box-shaped housing part is protruded from the one end wall so as to cover the through hole from an outside in the rotation axis direction, and when the conveying member moves from the coupling position to the release position, the hook is stored in the housing part.

5. The toner case according to claim 3, wherein the conveying member includes:

a conveying shaft configured to extend along the rotation axis direction; and a spiral conveying blade provided around an outer circumference of the conveying shaft, wherein the hook is provided at one end portion in the rotation axis direction of the conveying shaft.

6. The toner case according to claim 1, usable as a waste toner box storing a waste toner after the toner case is used as a toner container storing a fresh toner.

7. An image forming apparatus comprising:

the toner case according to claim 1; and an attachment part to which the toner case is detachably attached.

8. The image forming apparatus according to claim 7, further comprising:

a development device to which the toner is replenished from the toner case;

a position detecting part configured to detect a position of the conveying member; and a notification part configured to notify a user that a toner replenishment operation from the toner case to the development device is restricted when the position detecting part detects that the conveying member is in the release position.

9. A toner case comprising:

a case main body configured to store a toner and having a discharge port for the toner;

a conveying member configured to rotate around a rotation axis extending along a rotation axis direction and to convey the toner in the case main body to the discharge port;

a transmitting member configured to transmit rotation to the conveying member; and a manipulation member, at least a part of the manipulation member being provided outside the case main body, wherein the conveying member is movable along the rotation axis direction with respect to the transmitting member between a coupling position where the conveying member is coupled to the transmitting member and a release position where a coupling of the conveying member to the transmitting member is released, and wherein as the manipulation member is manipulated, the conveying member moves from the coupling position to the release position.

10. A toner case comprising:

a case main body configured to store a toner and having a discharge port for the toner;

a conveying member configured to rotate around a rotation axis extending along a rotation axis direction and to convey the toner in the case main body to the discharge port;

a transmitting member configured to transmit rotation to the conveying member; and a shutter configured to open and close the discharge port, wherein the conveying member is movable along the rotation axis direction with respect to the transmitting member between a coupling position where the conveying member is coupled to the transmitting member and a release position where a coupling of the conveying member to the transmitting member is released, and wherein as the shutter closes the discharge port, the conveying member moves from the coupling position to the release position.

11. The toner case according to claim 10, wherein the shutter is displaceable among a first position where the shutter closes the discharge port and positions the conveying member to the coupling position, a second position where the shutter opens the discharge port and positions the conveying member to the coupling position, and a third position where the shutter closes the discharge port and positions the conveying member to the release position.

12. An image forming apparatus comprising:

a toner case including:

a case main body configured to store a toner and having a discharge port for the toner;

a conveying member configured to rotate around a rotation axis extending along a rotation axis direction and to convey the toner in the case main body to the discharge port; and a transmitting member configured to transmit rotation to the conveying member, an attachment part to which the toner case is detachably attached;

a controller configured to determine whether the case main body is in a toner empty state or not; and an operation member configured to move the conveying member from the coupling position to the release position when the controller determines that the case main body is in the toner empty state, wherein the conveying member is movable along the rotation axis direction with respect to the transmitting member between a coupling position where the conveying member is coupled to the transmitting member and a release position where a coupling of the conveying member to the transmitting member is released; and the operation member is provided at the attachment part.

* * * * *